US009440778B2

(12) United States Patent
Prater et al.

(10) Patent No.: US 9,440,778 B2
(45) Date of Patent: Sep. 13, 2016

(54) PACKAGE AND METHOD OF MAKING A PACKAGE

(75) Inventors: Rodney L. Prater, Oak Creek, WI (US); Raechell Maria Thuot, Racine, WI (US); Courtney Marie Deary, Brooklyn, NY (US); Kathleen Corcoran Carr, Brooklyn, NY (US)

(73) Assignee: S. C. Johnson & Son, Inc., Racine, WI (US)

( * ) Notice: Subject to any disclaimer, the term of this patent is extended or adjusted under 35 U.S.C. 154(b) by 1123 days.

(21) Appl. No.: 13/526,218

(22) Filed: Jun. 18, 2012

(65) Prior Publication Data

US 2013/0334085 A1 Dec. 19, 2013

(51) Int. Cl.

| | |
|---|---|
| ***B65D 85/00*** | (2006.01) |
| ***B65D 75/32*** | (2006.01) |
| ***B65D 77/20*** | (2006.01) |
| ***B65D 81/02*** | (2006.01) |

(52) U.S. Cl.

CPC ..... *B65D 75/325* (2013.01); *B65D 77/2024* (2013.01); *B65D 81/025* (2013.01)

(58) Field of Classification Search

CPC ..... B65D 2203/00; B65D 75/325; B65D 77/2024; B65D 81/025

USPC ..... 206/459.5, 457, 524.1, 524.2, 524.3

See application file for complete search history.

(56) References Cited

U.S. PATENT DOCUMENTS

| | | | | |
|---|---|---|---|---|
| 3,972,418 | A | 8/1976 | Schuler et al. | |
| 4,301,923 | A * | 11/1981 | Vuorento | B65D 75/5822 206/484 |
| 4,423,819 | A * | 1/1984 | Cummings | A61J 1/1406 156/69 |
| 4,786,534 | A * | 11/1988 | Aiken | A45D 40/0087 206/229 |
| D531,506 | S | 11/2006 | Aitkenhead | |
| D535,554 | S | 1/2007 | Kent | |
| D553,007 | S | 10/2007 | Goodwin et al. | |
| D558,606 | S | 1/2008 | Watson et al. | |
| D571,672 | S | 6/2008 | Murray | |
| D599,214 | S | 9/2009 | Born et al. | |
| D599,657 | S | 9/2009 | Bruno et al. | |
| D607,323 | S | 1/2010 | Bruno et al. | |
| D614,491 | S | 4/2010 | Rhoad | |
| D619,018 | S | 7/2010 | Karay et al. | |
| 7,854,320 | B2 | 12/2010 | Greene et al. | |
| D632,564 | S | 2/2011 | Caldwell et al. | |
| D634,649 | S | 3/2011 | Wonderley et al. | |
| D642,910 | S | 8/2011 | Graham et al. | |

(Continued)

FOREIGN PATENT DOCUMENTS

| | | |
|---|---|---|
| JP | 2004216362 | 8/2004 |

OTHER PUBLICATIONS

Int'l Search Report & Written Opinion of PCT/US2013/045368 dated Sep. 17, 2013.

*Primary Examiner* — Jacob K Ackun
*Assistant Examiner* — Jenine Pagan

(57) ABSTRACT

A package for a consumer product includes a container foaming a cavity adapted to hold a consumer product and a film attached to an edge of the container to enclose the cavity. The film has a layer of polymeric material with printed images or text on a side of the film facing the cavity and a layer of lacquer applied to a side of the layer of polymeric material facing away from the container. The lacquer has a viscosity of between about 19 and about 23 seconds on a number 2 zahn cup.

13 Claims, 11 Drawing Sheets
(2 of 11 Drawing Sheet(s) Filed in Color)

(56) References Cited

U.S. PATENT DOCUMENTS

D646,567 S 10/2011 Graham et al.
2006/0231447 A1* 10/2006 Fensham ..... B65D 75/36 206/471
2007/0090010 A1 4/2007 Crabtree
2008/0030864 A1* 2/2008 Gougeon ..... G11B 33/0433 359/619
2009/0090643 A1* 4/2009 Fischer ..... B65D 75/5833 206/361
2009/0321292 A1 12/2009 Prudden, Jr. et al.
2010/0155288 A1 6/2010 Harper et al.
2010/0181225 A1* 7/2010 Spallek ..... B32B 15/08 206/528
2011/0024321 A1* 2/2011 Tilton ..... B65D 73/0057 206/459.5
2011/0049003 A1* 3/2011 Bellamah ..... B32B 15/08 206/531
2011/0303571 A1 12/2011 Loce

* cited by examiner

PACKAGE AND METHOD OF MAKING A PACKAGE

BACKGROUND

1. Field of the Disclosure

The present invention relates generally to a package for one more consumer products, and more particularly, to features for a package enclosing one or more consumer products within the package.

2. Description of the Background

With the number of new consumer products on the market increasing, shelf space in retail stores for particular products has become a commodity. It is therefore even more desirable than ever for sellers of consumer products to design packages for holding the consumer products that are visually appealing and memorable. In a retail setting, the hottest selling consumer products may be those that best attract the attention of a passing consumer.

A number of package designs have been developed and sold over the years that include features intended to attract consumers. For example, some packages include a clear or translucent material that allows a consumer to view the product(s) contained in the package without touching the package and while the package is in a display position. Others include colors or graphics that draw a consumer to the product. Sellers of consumer products are always and probably always will be looking for new and unique ways to make their product package stand out.

SUMMARY

According to one aspect of the present invention, a package for a consumer product includes a container forming a cavity adapted to hold a consumer product and a film attached to an edge of the container to enclose the cavity. The film includes a layer of polymeric material with printed images or text on a side of the film facing the cavity. A layer of lacquer is applied to a side of the layer of polymeric material facing away from the container, wherein the lacquer has a viscosity of between about 19 and about 23 seconds on a number 2 zahn cup.

According to another aspect of the present invention, a method of making a package for a consumer product includes the step of applying a lacquer having a viscosity of between about 19 and about 23 seconds on a number 2 zahn cup to a first side of a clear thermoplastic layer of material to create a matte effect. The method further includes the steps of printing images or text on a second side of the clear thermoplastic layer to create a film and attaching the film to edges of a thermoplastic container to enclose a consumer product within the container.

In a different aspect of the present invention, a package for a consumer product includes a container forming a cavity adapted to hold a consumer product and a film attached to an edge of the container to enclose the cavity. The package further includes a first pattern disposed on or adjacent at least a portion of a wall of the container opposite the film, wherein the pattern has a density that increases in a first direction. A second pattern is disposed on at least a portion of the film, wherein the pattern has a density that increases in a second direction, wherein the second direction is different than the first direction. The first and second patterns together form a visual effect.

BRIEF DESCRIPTION OF THE DRAWINGS

The patent or application file contains at least one photograph executed in color. Copies of this patent or patent application publication with color photograph(s) will be provided by the Office upon request and payment of the necessary fee.

Other aspects and advantages of the present invention will become apparent upon consideration of the following detailed description, wherein similar structures have like or similar reference numerals.

DETAILED DESCRIPTION

The present invention is directed to a package for holding one or more refills and/or a volatile material dispensing device. While the present invention may be embodied in many different forms, several specific embodiments are discussed herein with the understanding that the present invention is to be considered only as an exemplification of the principles of the invention, and it is not intended to limit the invention to the embodiments illustrated.

Figure 1:
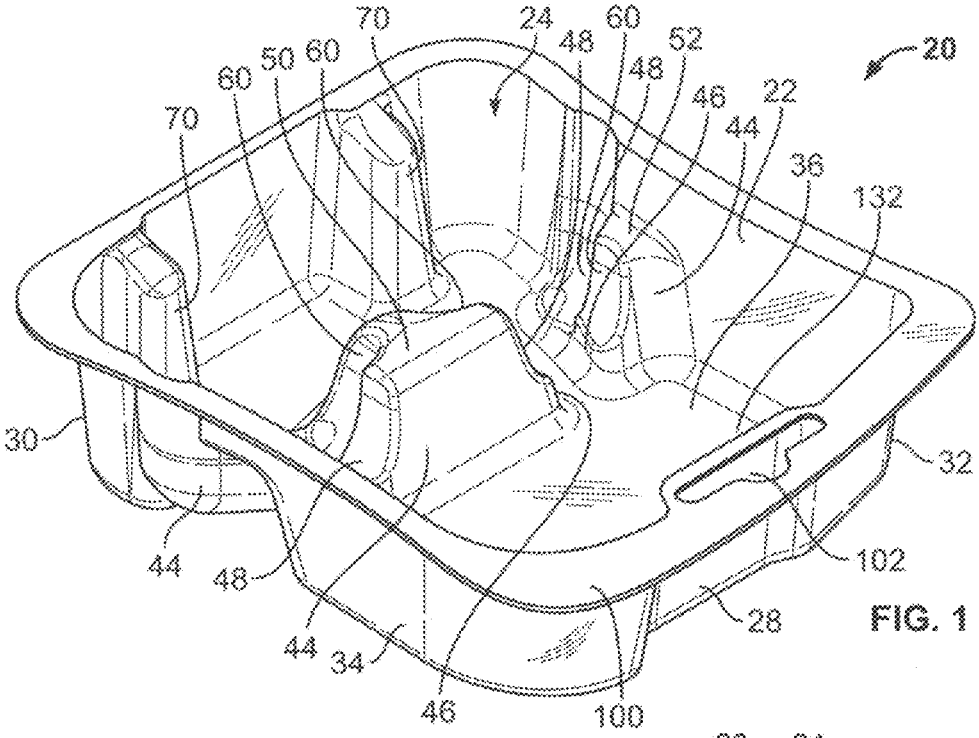
FIG. 1 is a top isometric view of a first embodiment of a package depicting a blister-type container of the package with a film removed from a top of the blister-type container for clarity.
Figure 5:
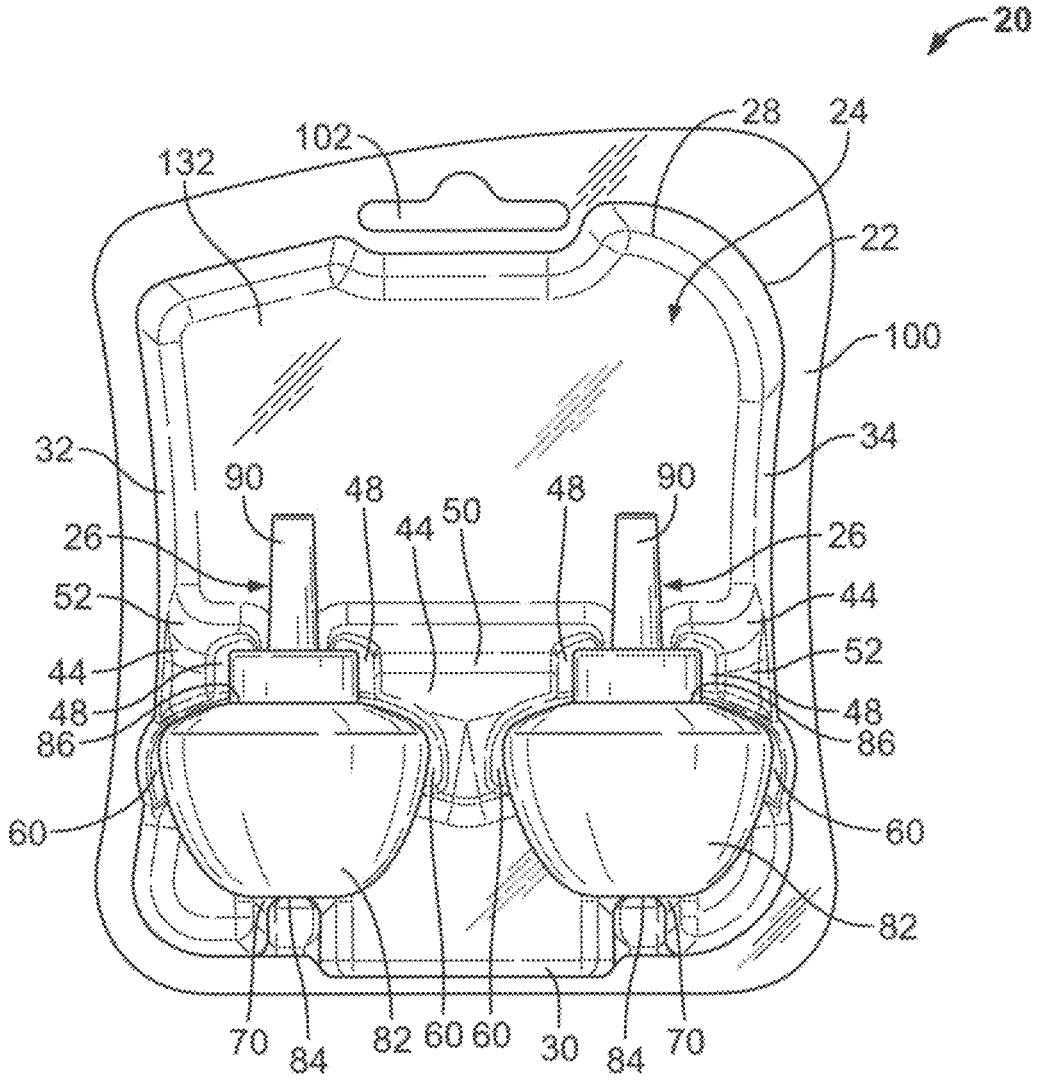
FIG. 5 is a front elevational view similar to that of FIG. 2 depicting two refills disposed within the blister-type container.

Referring to the drawings, FIG. 1 depicts a first embodiment of a package 20 (with portions of the package removed). The package 20 generally includes a thermoformed blister-type container 22 having a cavity 24 for holding one or more refills 26 (FIGS. 5 and 7) and/or a device (not shown). The thermoformed blister-type container 22 includes a top wall 28, a bottom wall 30, two side walls 32, 34, and a rear surface 36 that form the cavity 24. The rear surface 36 may include one or more projections formed integrally with the thermoformed package 20 and which extend into the cavity 24. The projections have surfaces that conform to the one or more refills 26 and/or the device in order to hold same within the package 20 and prevent movement of same within the package 20.

Figure 2:
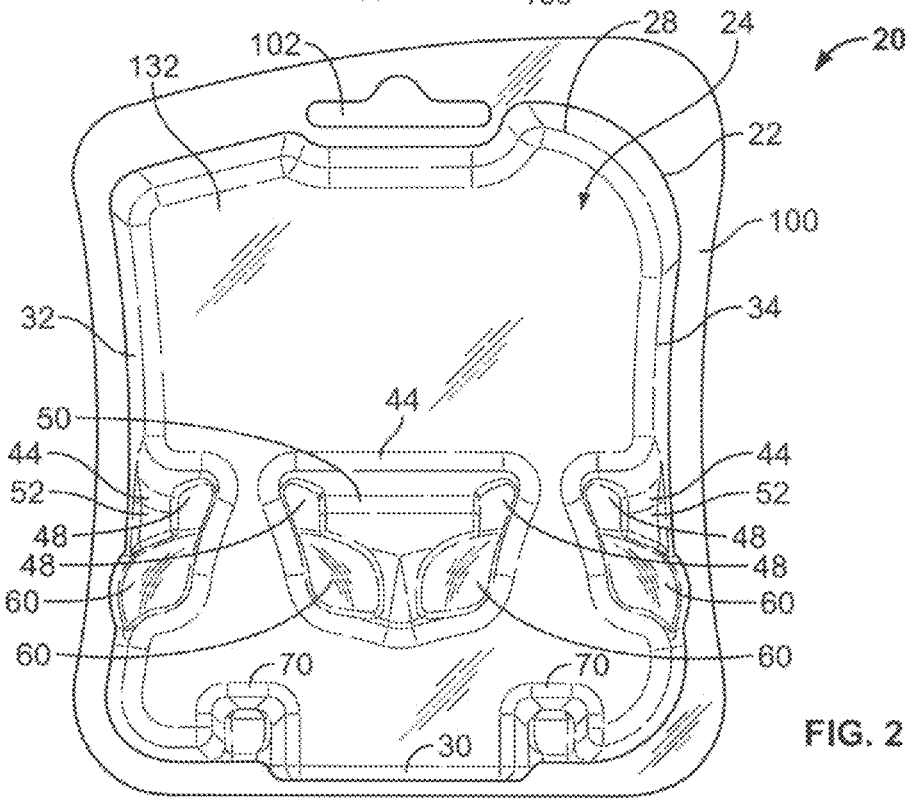
FIG. 2 is a front elevational view of the package of FIG. 1.

As seen in FIGS. 1 and 2, a plurality of central projections 44 are formed integrally with the blister-type container 22 and extend inwardly from the rear surface 36 and/or side walls 32, 34. Each of the central projections 44 includes, on opposite sides thereof (or on one side for the projections 44 that extend from the side walls 32, 34), a first tapered surface 46 extending from the rear surface 36. A second tapered and curved surface 48 extends from the first tapered surface 46 and terminates in a flat surface 50 or an angled surface 52 (for the projections 44 that extend from the side walls 32, 34). Arced indents 60 are disposed below each of the first and second tapered surfaces 46, 48. The blister-type container 22 further includes a plurality of projections 70 formed integrally with the blister-type container 22 and extending along the bottom wall 30 of the blister-type container 22.

One or more refills 26 may be placed within the cavity 24. The refill(s) 26 generally include a container 82 for holding a volatile material and having a generally flat bottom 84 and an opposite open neck 86. A wick is disposed within the container 82 in contact with the volatile material and extends out of the container 82. A cap 90 is attached to the neck 86 to cover the wick.

Figure 7:
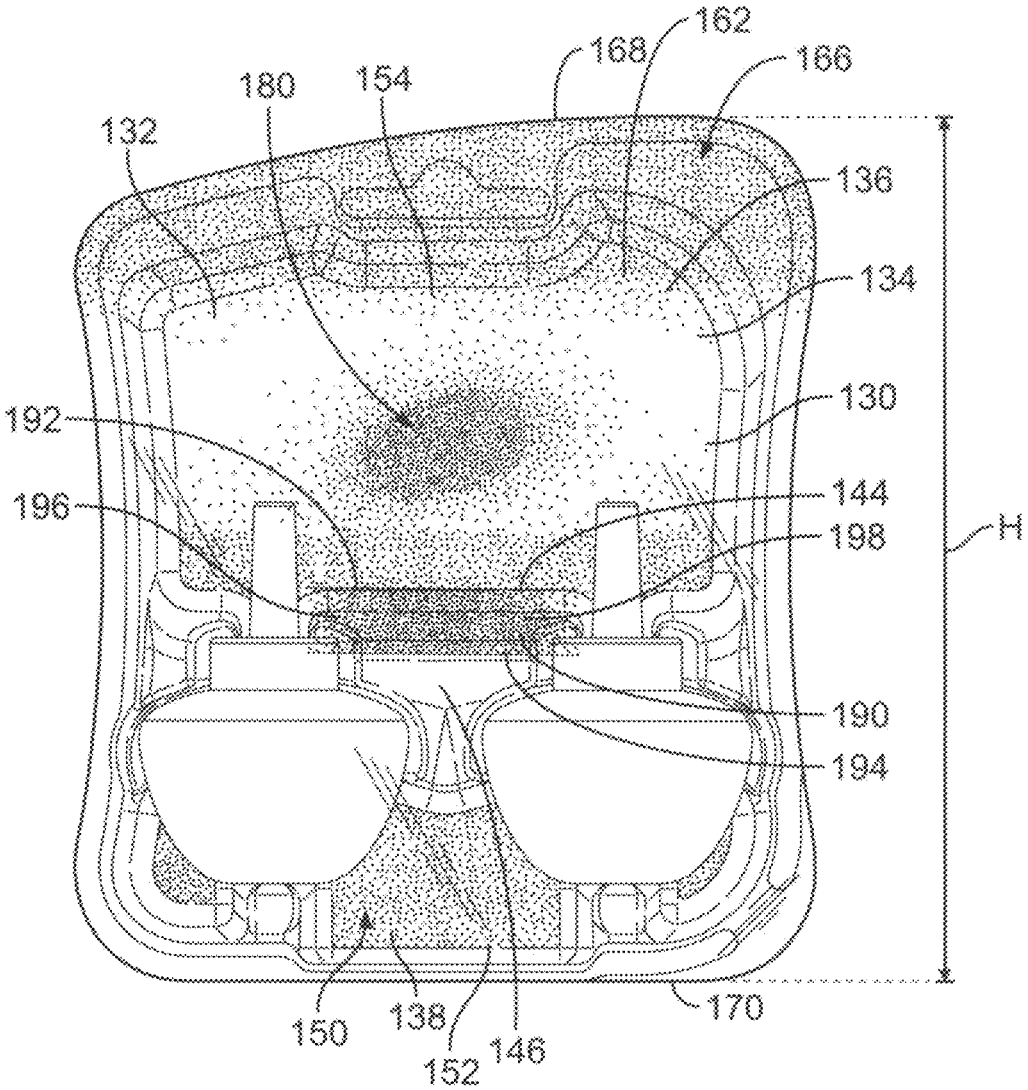
FIG. 7 is a front elevational view similar to the view of FIG. 5 depicting the insert disposed within the rear portion of the blister-type container, two refills disposed within the blister-type container adjacent the insert, and the film attached to the flange of the blister-type container.

The refill(s) 26 are inserted into the blister-type container 22 such that the bottom 84 of each refill 26 sits on one of the projections 70 extending from the bottom wall 36, causing the refill 26 to look like it is floating within the package 20 when the package 20 is assembled, as seen in FIG. 7. The refills 26 are further situated with the neck 86 (and a portion of the cap 90) of each refill 26 disposed between adjacent second tapered surfaces 48 and upper shoulders 92 of the container 82 disposed within the arced indents 60. The projections 70, the first tapered surfaces 46, and the arced indents 60 function to retain the refill(s) 26 in position. When the thermoformed blister-type container 22 is enclosed, a film enclosing the blister-type container 22 abuts a front face of the container 82 of the refill 26 to further retain the refill 26. In this manner, during the manufacturing process, which will be discussed in detail hereinafter, the film may be attached after the refills 26 are inserted into the blister-type package 22, with the film 110 adjacent the refills 26, thereby leaving little or no room for forward movement of the refills 26.

Figure 3:
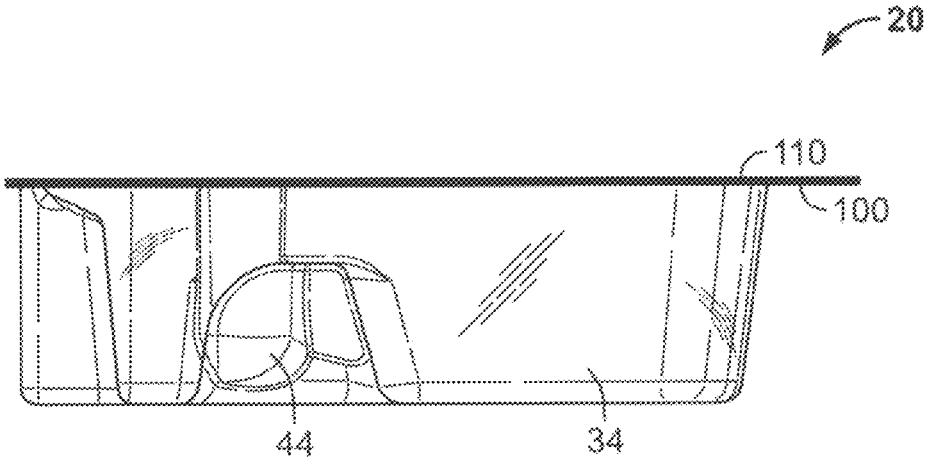
FIG. 3 is a side elevational view of the package of FIG. 1 with the film attached to a flange extending outwardly from the blister-type container.
Figure 4:
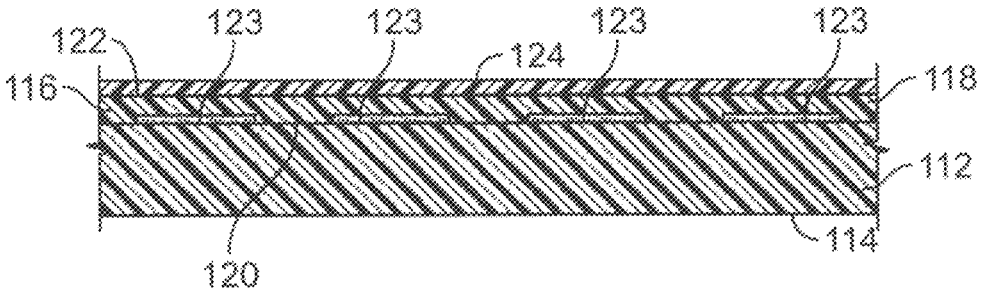
FIG. 4 is an enlarged cross-sectional view taken generally along the lines 4-4 of FIG. 3 and showing the structure of the film.

As best seen in FIGS. 3 and 4, a flange 100 extends outwardly from upper edges of each of the top wall 28, the bottom wall 30, and the side walls 32, 34. The flange 100 is large enough to attach a film thereto, as discussed in greater hereinafter. One or more apertures 102 may be formed through the flange 100 for suspending the package 20 from a hook or other hanger.

Figure 6:
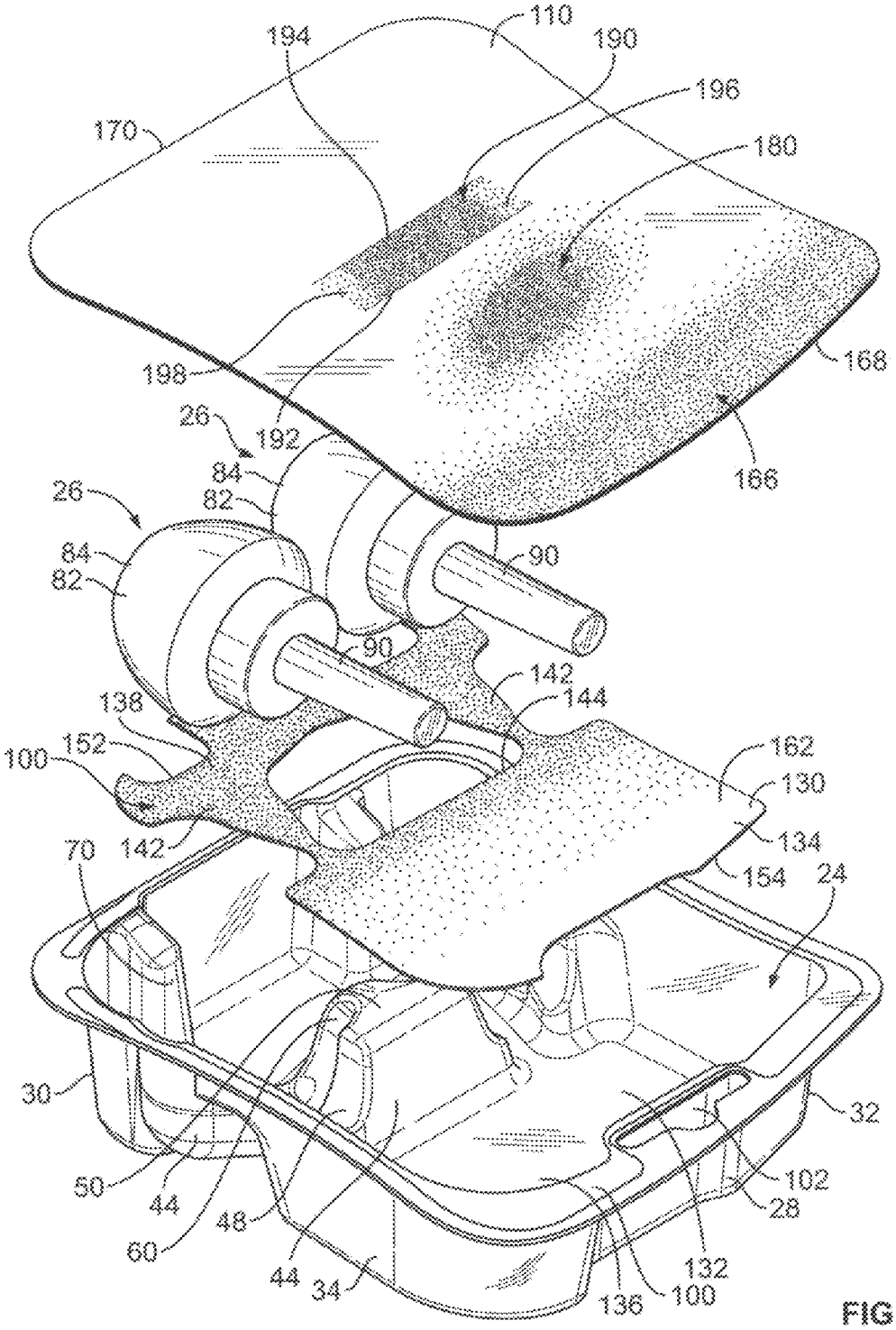
FIG. 6 is an exploded view of the package of FIG. 2 including the blister-type container, an insert, two refills, and the film.

A film 110 is laminated to the flange 100 to enclose the one or more refills 26 and/or device, as best seen in FIGS. 3, 6, and 7. The film 110 includes a bottom layer 112 that is a clear recycled polyethylene terephthalate (RPET) having a thickness of between about 18 mils and about 40 mils, more preferably between about 20 mils and about 30 mils, and most preferably about 20 mils and a basis weight of about 43.6 pounds per 3000 square inches. For larger packages 20 requiring larger films 110 (for example, those having a width across the package 20 greater than about 120 mm), the thickness of the bottom layer 112 is preferably about 25 mils. The bottom layer 112 may be heat sealable so the film 110 may be applied through the use of heat to the flange 100 of the blister-type container 22. The bottom layer 112 further includes bottom and top sides 114, 116.

The film 110 further includes a top layer 118 that is a clear PET preferably having a thickness of between about 0.96 mil and about 4.0 mils, more preferably between about 1.5 mils and about 3.5 mils, and most preferably about 2.6 mils and a basis weight of about 13 pounds per 3000 square inches. The top layer 118 also includes bottom and top sides 120, 122. The bottom side 120 of the top layer 118 is printed with ink 123 to form graphics, as best seen in FIGS. 4, 6, and 7, and a layer of lacquer 124 is applied to the top side 122 of the top layer 118. The bottom and top layers 112, 118 are attached by an adhesive having a basis weight of about 1.8 pounds per 3000 square inches. The overall film 110 has a basis weight of about 59 pounds per 3000 square inches and a caliper of about between about 19 mils and about 44 mils, and most preferably about 22.6 mils (or 27.6 mils for larger films 110).

Prior to application and immediately after application the lacquer 124 has a viscosity that is between about 19 and about 23 seconds on a number 2 zahn cup and a basis weight of about 0.7 pounds per 3000 square inches. The layer of lacquer 124 preferably has a thickness of between about 0.1 mil and about 0.5, more preferably between about 0.15 and about 0.4 mil, and most preferably about 0.2 mil.

Referring to FIGS. 6 and 7, the package 20 and the components of the package are shown exploded (FIG. 6) and assembled (FIG. 7). When assembled, an insert 130 having a shape that generally conforms to a flat portion 132 of the rear surface 36 of the blister-type container 22 is disposed adjacent the flat portion 132 of the blister-type container 22. The refills 26 are held within the blister-type container 22 by the projections 44, as described in detail above, and the film 110 is attached to the flange 110 of the blister-type container 22 to enclose the refills 26.

The insert 130, as noted above, generally takes the shape of the flat portion 132 of the rear surface 36 of the blister-type container 22. Specifically, referring to FIG. 6, the insert 130 includes a first bulbous portion 134 disposed within a top portion 136 of the blister-type container 22 and a second, less bulbous portion 138 disposed within a bottom portion 140 of the blister-type container 22. Two narrowed portions 142 of the insert 130 extend between the first and second bulbous portions 134, 138 and are positioned behind the refills 26 (and between the projections 44, which form the shape of the insert 130). The narrowed portions 142 create a generally horizontal edge 144 at a bottom of the first bulbous portion 138. A non-patterned, clear area 146 is formed in the blister-type container 22 between the horizontal edge 144, the two narrowed portions 142, and the second bulbous portion 138.

The film 110 and the insert 130 include graphics that combine to form a visual effect that is soft and pleasing to the eye. In particular, the insert has a first pattern 150 that has a density that decreases or gradates from a bottom edge 152 of the insert 130 toward a top edge 154 of the insert 130 (or, said another way, a density that increases from the top edge 154 to the bottom edge 152 of the insert 130). In one embodiment, the first pattern 150 is a color gradient, wherein the color appears to slowly fade away as the pattern 150 moves away from the bottom edge 152 of the insert 130 (toward the top edge 154). The first pattern 150 completely fades away near the top edge 154 of the insert 130, revealing a non-colored portion 162 of the insert 130, which in the embodiment of FIGS. 6 and 7 is white.

The film 110 includes a second pattern 166 having a density that decreases or gradates from a top edge 168 of the film 110 toward a bottom edge 170 of the film 110 (or, said another way, a density that increases from a bottom edge 170 to a top edge 168 of the film 110). In one embodiment, the second pattern 166 is a color gradient, wherein the color appears to fade away as the pattern 166 moves away from the top edge 168 (toward the bottom edge 170). Once the second pattern 166 has completely faded away, the original features of the film 110 are revealed. In the embodiment of FIGS. 6 and 7, the film 110 is clear (except for other areas containing one or more patterns) with a matte finish over the entire film.

Referring to FIGS. 6 and 7, the first pattern 150 extends along a greater height H of the package 20 than the second pattern 166. In this manner, the first pattern 150 fades away more slowly than the second pattern 166 and there is little, if any, overlap between the first and second patterns 150, 166, even at the lowest color gradient or density. The first and second patterns 150, 166 therefore appear to fade into one another and provide a warm glow to the package 20. The non-colored portion 162 of the insert 130 is disposed behind a portion of the second pattern 166 having a lower color gradient, creating a white glow behind a portion of the second pattern 166 that accentuates the color of the second pattern 166.

The film 110 further includes a third pattern 180 generally formed visually over and in front of a portion of the first pattern 150 having a lower color gradient or density and over a portion of the non-colored portion 162. The third pattern 180 is generally oval in shape and gives a frosted look to the film 110, which blends in with the non-colored portion 162 of the insert 130 and softens the color of the portion of the first pattern 150 it overlaps.

A fourth pattern 190 is formed on the film 110 and may include a vertical strip of color across the film 110. The strip of color includes a top edge 192, a bottom edge 194, and opposing side edges 196, 198. The top edge 192 is spaced from the third pattern 180 and generally aligned with the horizontal edge 144 of the insert 130 such that the color of the insert 130 blends with the fourth pattern 190 on the film. The side edges 196, 198 of the fourth pattern 190 have a color gradient that decreases as the strip of color moves outwardly.

A fifth pattern may be formed on the film 110 and may include color, graphics, text, and/or any other pattern. The fifth pattern, in some embodiments, is formed over the non-patterned, clear area 146 of the blister-type container 22 to hide or blur any colors, patterns, or other visual effects that may be picked up from other sources outside/behind the package 20.

Preferably, although not necessarily, the colors of the first, second, and fourth patterns 150, 166, and 190 are the same. Alternatively, the colors may be different. In addition, while the first and second patterns 150, 166 are disclosed as being color gradients, the first and second patterns 150, 166 may alternatively, or in addition, include a different pattern.

Figure 7A:
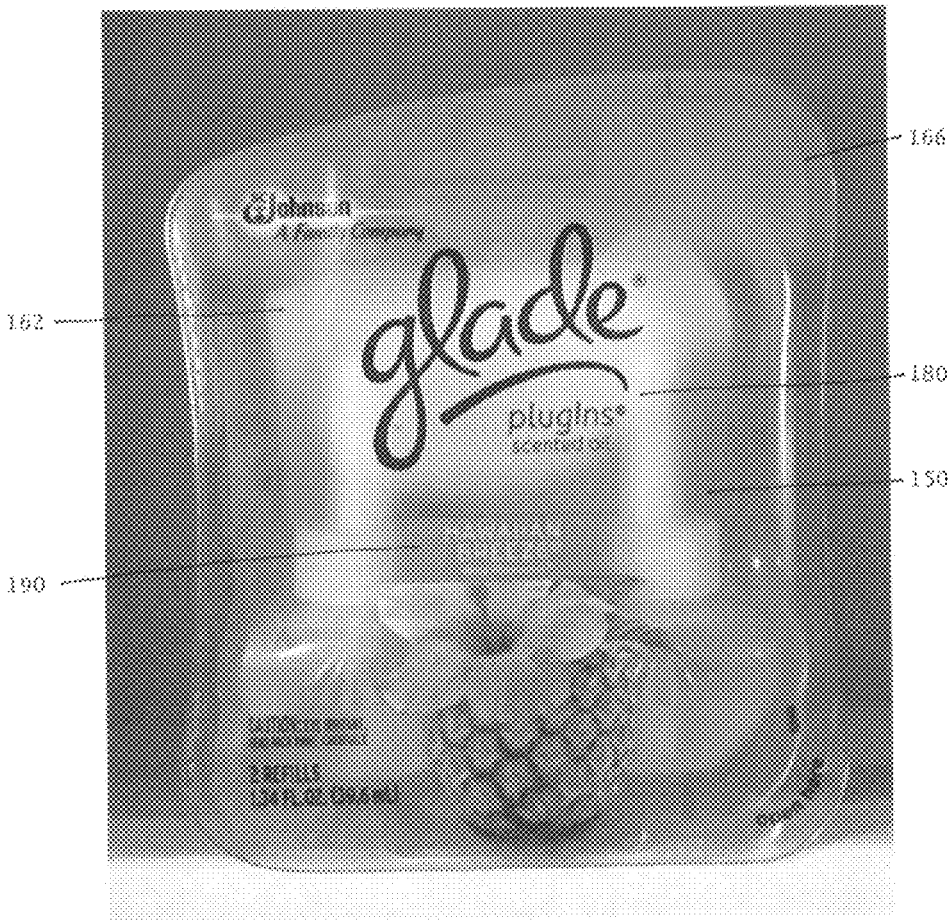
FIG. 7A is a front elevational view similar to the view of FIG. 7 and depicting patterns and visual effects created by those patterns on the package of FIG. 1 in color.
Figure 7B:
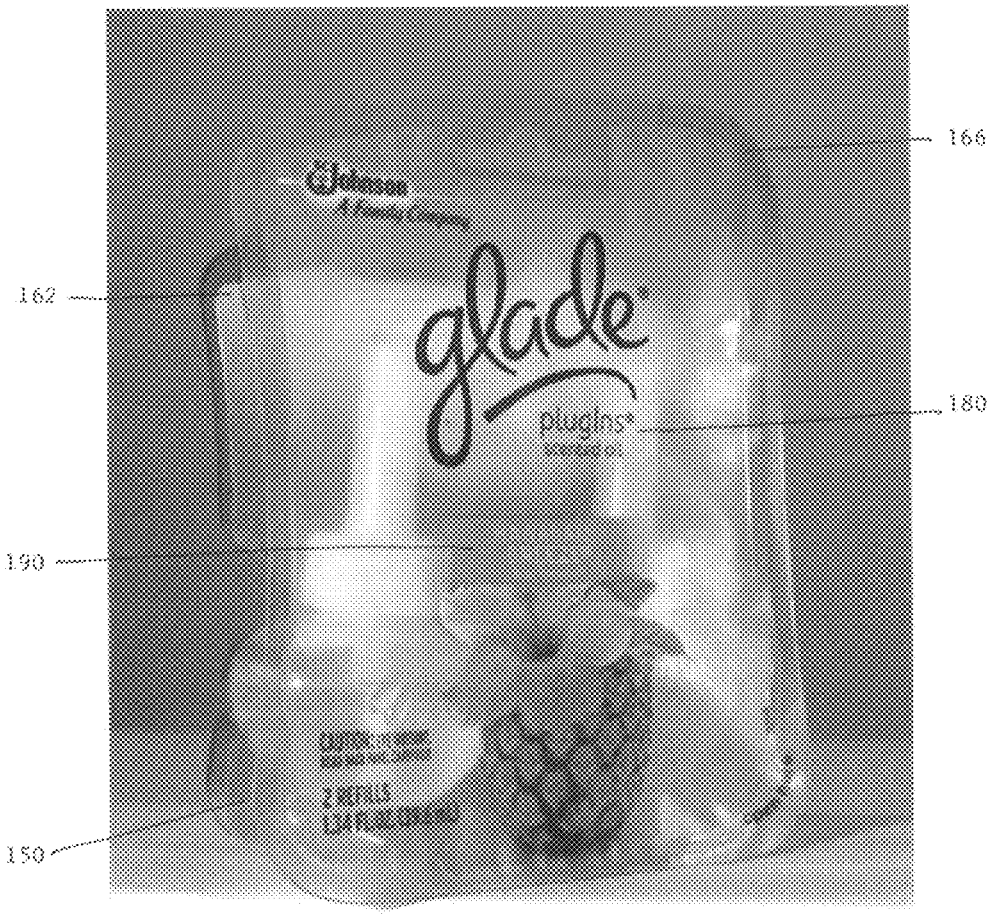
FIG. 7B is an isometric view of a side of the package depicting the patterns and visual effects of FIG. 7A.

When viewed from the front, as seen in FIGS. 7, 7A, and 7B, the layer of lacquer 124 provides a matte finish that that gives the package 20 and contents a softer look that is visual pleasing. The difference in depth between the first pattern 150 and the second, third, fourth, and fifth patterns 166, 180, 190 also creates a three-dimensional effect that blends together to create a visual effect that is pleasing to the eye. The reverse gradation of the first pattern 150 where there is no second pattern 166 gives depth to the first pattern 150 and further gives the refills 26 (or other product) depth because the color of the first pattern 150 can be viewed through the refills 26. The patterns 150, 166, 180, 190 combine to provide a warm visual appearance that is attractive and pleasing. While multiple patterns are disclosed, a package need not include every pattern disclosed herein. Rather, many combinations of the patterns disclosed herein may be utilized. In one embodiment, only the first and second patterns 150, 166 are utilized.

Figure 8:
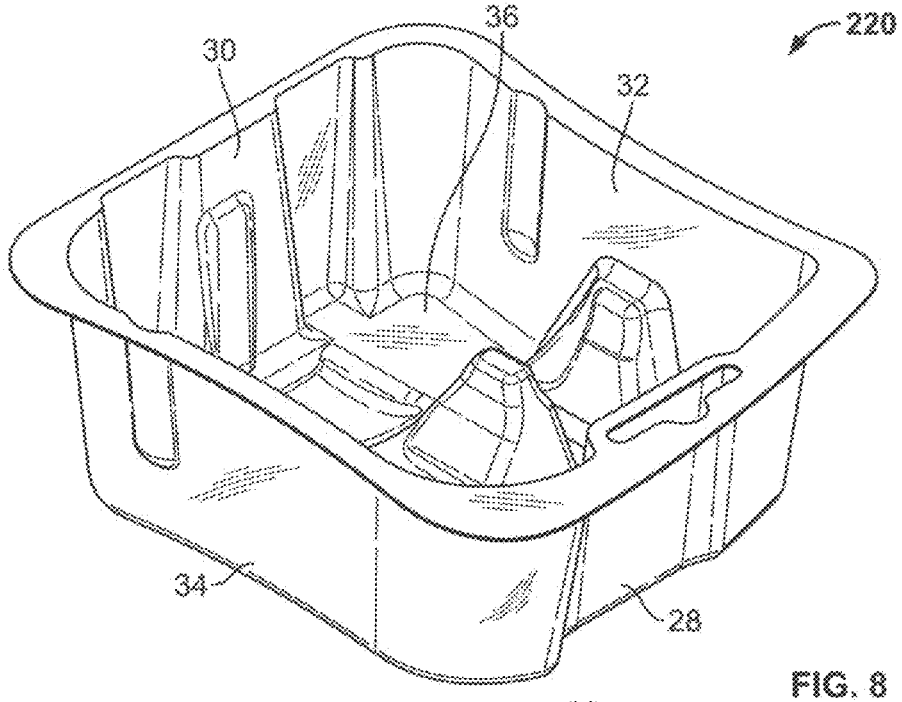
FIG. 8 is a top isometric view of a second embodiment of a package and showing a blister-type container of the package with a film removed from a top of the blister-type container for clarity.
Figure 9:
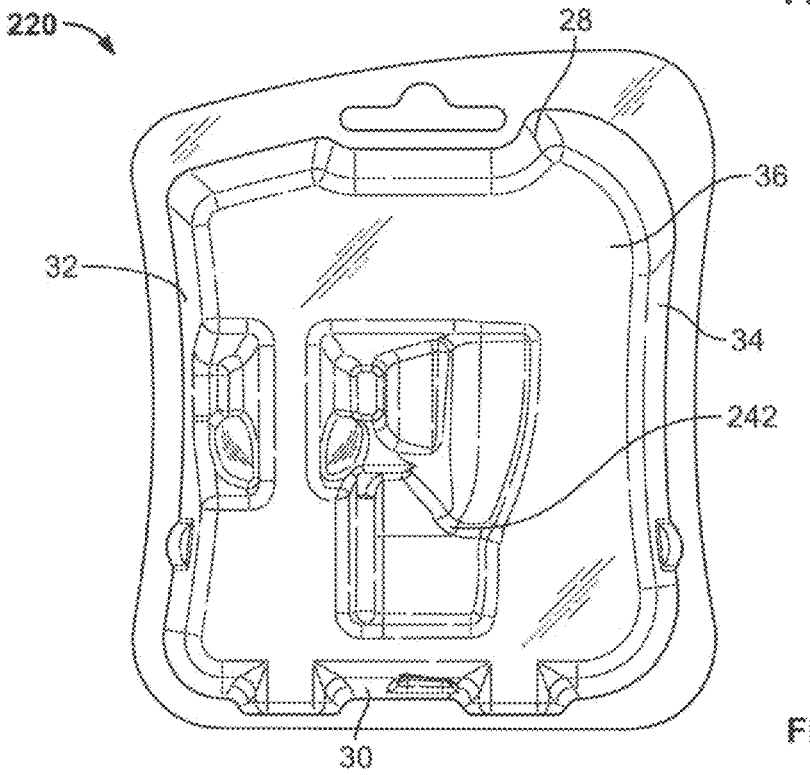
FIG. 9 is a front elevational view of the package of FIG. 8.
Figure 10:
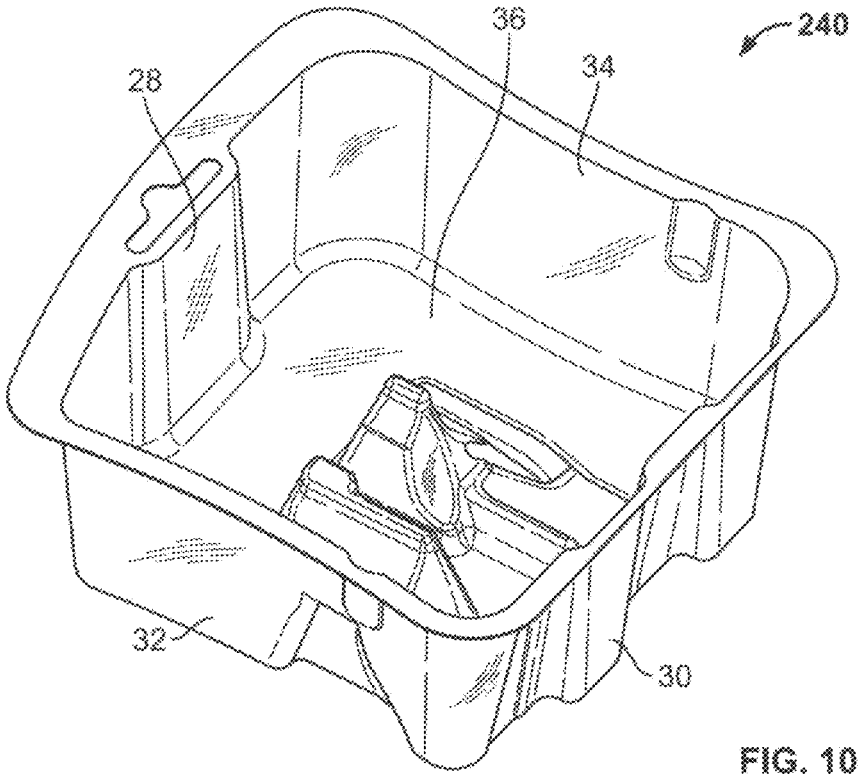
FIG. 10 is a top isometric view of a third embodiment of a package and showing a blister-type container of the package with a film removed from a top of the blister-type container for clarity.
Figure 11:
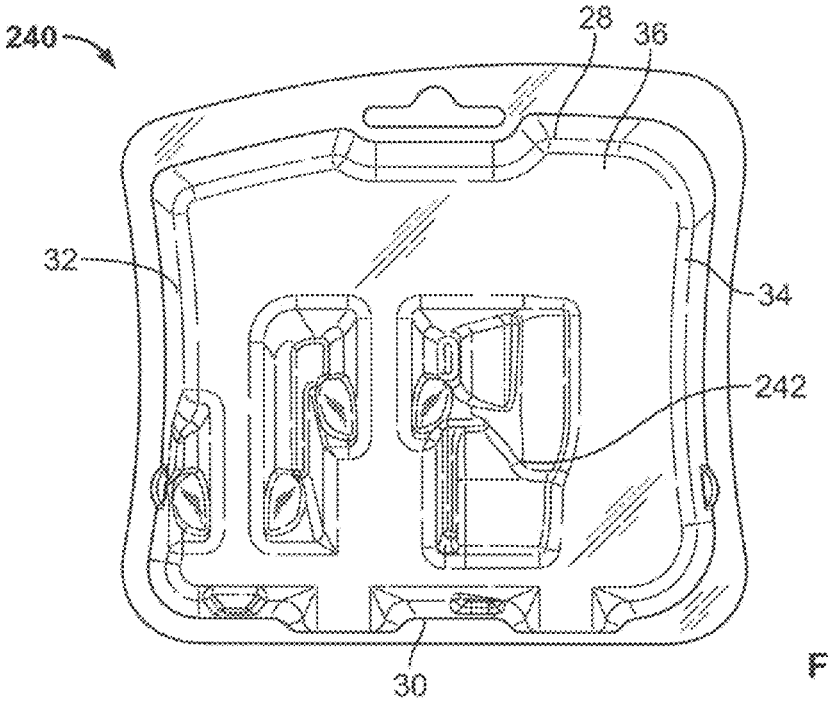
FIG. 11 is a front elevational view of the package of FIG. 10.

The features of the package 20 described in relation to FIGS. 1-7 may be incorporated into other packages, for example, the package 220 of FIGS. 8 and 9 or the package 240 of FIGS. 10 and 11. Additionally, the package may include any consumer product. The packages 220, 240 are similar to the package 20, except that the packages 220, 240 accommodate one or more refills and a device (not shown). In this manner, one or more additional projections 242 extend from the rear surface 36 of the blister-type container 22 to retain the device in position. In these embodiments, the device is positioned with a front of the device facing to the left rather than out of the package 220, 240. In addition, one or more of the refills may be turned 90 degrees to conserve on space within the package 220, 240. If one or more refills is turned 90 degrees in any package, the same features for retaining the refill are utilized, but the features may be less pronounced and the space between the features is not as great.

While a few packages having varying combinations of one or more refills or one or more refills and a device are shown and described herein, any combination of refills and/or devices may be utilized with any of the features described herein.

Figure 12:
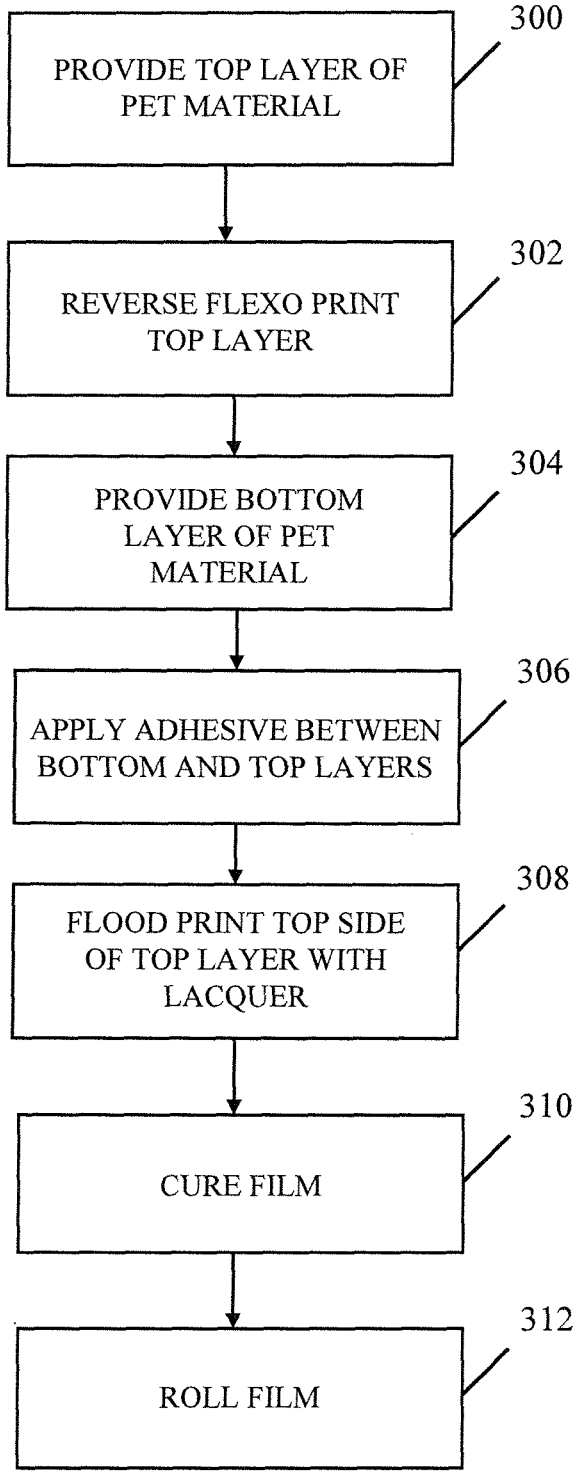
FIG. 12 is a flow diagram of a process for manufacturing the film depicted in FIG. 4 and further depicting a first phase of manufacturing any of the packages shown and described herein.
Figure 13:
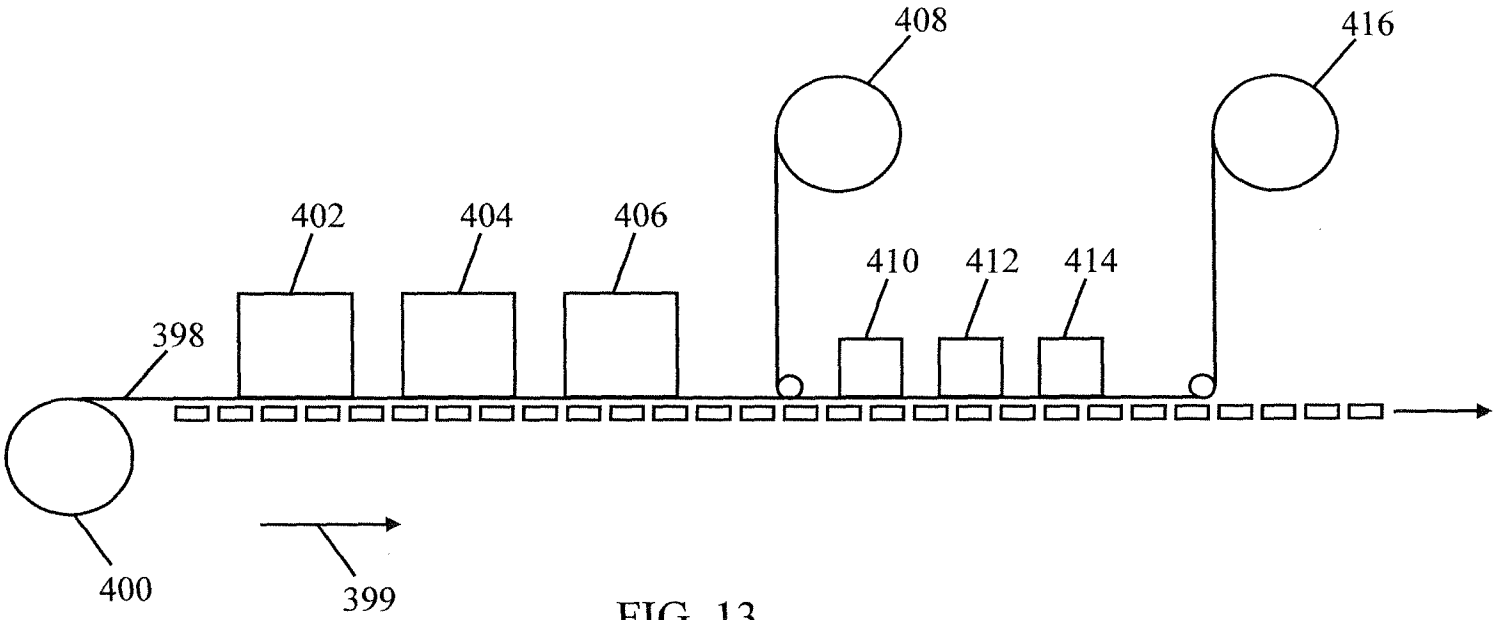
FIG. 13 is a schematic depiction of a packaging apparatus showing a second phase of a process for manufacturing any of the packages shown and described herein.

The films of the present disclosure may be made by a process as depicted in FIGS. 12 and 13. In a first phase of the process, as seen in FIG. 12, the top layer 118 of PET material is provided at block 300, and thereafter, the bottom side 120 of the top layer 118 is printed using a reverse flexographic printing process at block 302. The bottom layer 112 of PET material is provided at block 304 and an adhesive is thereafter applied between the bottom side 120 of the top layer 118 and a top side of the bottom layer 112 to create a lamination bond at block 306. After the top and bottom layers 118, 112 have been laminated, a gravure cylinder is utilized at block 308 to flood print a matte lacquer on the top side 122 of the top layer 118 of the film 110. Once assembled and flood printed, the film 110 is cured with ultraviolet light at block 310 and rolled at block 312.

In a second phase of the process, as depicted from the schematic view of a packaging apparatus of FIG. 13, a recycled PET film 398 is unwound from a roller 400 and travels along a machine direction 399 through a plurality of stations until the film 398 (and other added components) form a finished product. As the film 398 travels along the machine direction 399, heat is applied at a station 402 and molds are used in combination with the heat to form the blister-type container 22. Once the blister-type container 22 is formed, the blister-type containers 22 pass through a station 404 that deposits the inserts 130 adjacent the rear surface 36 of the blister-type containers 22. Thereafter, the refills 26 and/or device are inserted into the blister-type container 22 at a station 406, with the insert 130 disposed between the refill 26 and the rear surface 36 of the blister-type container 22.

Still referring to FIG. 13, once the appropriate components have been deposited within the blister-type containers 22, the containers 22 travel to a section where the film 110 created in the first phase of the process is unwound from a roller 408 and is attached to the flange 100 of the blister-type container 22 by heat sealing at a station 410. The blister-type container 22 is thereafter moved to a station 412 in which the aperture 102 (for hanging the package 20) is punched and then to a station 414 where the film 110 is punched around the shape of the flange 100 to form the package 20. The remnants of the film 110 are thereafter wound onto a roller 416 and the formed packages 20 are transported by a conveyor or the like to a packaging or other storage area.

While the process of FIGS. 12 and 13 are shown as being two separate phases, the phases of FIGS. 12 and 13 may be combined to create an inline process in which the film 110 is made and transported directly to the packaging apparatus of FIG. 13 between the stations 406 and 410. Further, while not shown in FIGS. 12 and 13, depending on the size of a particular package, any number of packages may be capable of being formed across a width of the film 398. In particular, in one non-limiting embodiment, if a package having a first width is manufactured, eight refills may be formed along the width of the film 398 and, if a package having a second width is manufactured, five refills may be formed along the width of the film 398.

While the package 20 of the present disclosure is described and shown herein as holding one or more refills having a wick and a liquid volatile material, the present disclosure may be utilized for any number of different refills, types of volatile materials, and/or device. In particular, the present disclosure may be used in conjunction with packaging for any dispensable substance and/or dispenser including, but not limited to, a fluid, a gas, a fragrance, a gel, an oil, an emulsion, a wax, a resin, an insect repellent, an insecticide, an air controlling agent, an odor eliminating agent, a cleaning agent, or any other substance.

In addition, certain aspects of the present disclosure, for example the color gradients used for the package 20, may be implemented in any packaging for a consumer product.

Any of the embodiments described herein may be modified to include any of the structures or methodologies disclosed in connection with other embodiments.

Further, although directional terminology, such as front, back, top, bottom, upper, lower, etc. may be used throughout the present specification, it should be understood that such terms are not limiting and are only utilized herein to convey the orientation of different elements with respect to one another.

All documents cited in the Detailed Description are, in relevant part, incorporated herein by reference; the citation of any document is not to be construed as an admission that it is prior art with respect to the present disclosure.

INDUSTRIAL APPLICABILITY

The present invention provides a package having a clear film coated with a lacquer that provides a matte finish to an outer, viewed surface of the package. The present invention further provides a package having a plurality of patterns on the package that form visually pleasing graphics. The present invention further provides a method of making the packages of the present invention.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

We claim:

1. A package for a consumer product, the package comprising:

a container forming a cavity adapted to hold a consumer product;

a film attached to an edge of the container to enclose the cavity;

a first pattern disposed on or adjacent at least a portion of a wall of the container opposite the film, the pattern having a density that increases in a first direction; and a second pattern disposed on at least a portion of the film, the pattern having a density that increases in a second direction, wherein the second direction is different than the first direction;

wherein the first and second patterns are spaced apart by the cavity and together form a visual effect.

2. The package of claim 1, wherein the first pattern is disposed on an insert separate from the container and disposed adjacent the wall of the container opposite the film.

3. The package of claim 1, wherein the first and second patterns are formed by color gradients.

4. The package of claim 3, wherein the film is coated with a layer of lacquer to mute the color gradients of the first and second patterns.

5. The package of claim 4, wherein the film includes a first layer of clear thermoplastic material coated on a first side with the layer of lacquer and the second pattern printed on a second side and a second thermoplastic layer attached to the second side of the first thermoplastic layer, wherein the second thermoplastic layer is adapted for attachment to the container.

6. The package of claim 4, further including a third pattern disposed on a portion of the film and blending with the first and second patterns.

7. The package of claim 1, further including at least one projection extending from a wall of the container into the cavity, wherein the projection is formed to create the appearance that a refill is floating within the package.

8. The package of claim 1, further including a plurality of projections extending from the wall of the container opposite the film and side walls of the container, wherein the plurality of projections have features that conform to a refill or volatile material device to position and are formed to retain the refill or volatile material device in position within the package.

9. A package for a consumer product, the package comprising:

a container forming a cavity adapted to hold a consumer product;

a film attached to an edge of the container to enclose the cavity, the film having a first layer of polymeric material made of recycled polyethylene terephthalate with printed images or text on a side facing the cavity; and a layer of lacquer applied to a side of the first layer of polymeric material facing away from the container, the lacquer having a viscosity of between about 19 and about 23 seconds on a number 2 zahn cup, a second clear polymeric layer having a first side attached to the first polymeric layer and a second side attached to a flange of the container.

10. The package of claims 9, wherein the film includes at least one clear polymeric layer having a first side coated with between about 0.1 mil and about 0.5 mil of the lacquer to give a matte look to the film.

11. The package of claim 10, wherein the second clear polymeric layer is heat sealable and is attached to the flange of the container by the application of heat.

12. The package of claim 10, wherein the first clear polymeric layer is attached to the second clear polymeric layer by a lamination bond.

13. The package of claim 10, wherein the first clear polymeric layer has a thickness of between about 0.96 mil and about 4.0 mils and the second clear polymeric layer is made of polyethylene terephthalate having a thickness of between about 18 mils and about 40 mils.

* * * * *